United States Patent [19]

Perri

[11] 4,050,668

[45] Sept. 27, 1977

[54] INGOT MOLD WITH HEAT REFLECTING COVER

[76] Inventor: Joseph Perri, 10 Dendron Drive, Coraopolis, Pa. 15108

[21] Appl. No.: 727,281

[22] Filed: Sept. 27, 1976

[51] Int. Cl.[2] ..... B22D 7/06

[52] U.S. Cl. ..... 249/106; 249/204

[58] Field of Search ..... 249/106, 197, 204, 199, 249/200; 220/215

[56] References Cited

U.S. PATENT DOCUMENTS

| | | | |
|---|---|---|---|
| 878,501 | 2/1908 | Burhans | 220/215 |
| 2,199,953 | 5/1940 | Hois et al. | 220/215 |
| 3,929,183 | 12/1975 | Vallar | 249/106 X |

FOREIGN PATENT DOCUMENTS

| | | | |
|---|---|---|---|
| 1,075,287 | 2/1960 | Germany | 249/204 |

*Primary Examiner*—Robert D. Baldwin
*Attorney, Agent, or Firm*—Parmelee, Miller, Welsh & Kratz

[57] ABSTRACT

The use of hot tops on ingot and similar molds in which steel, steel alloys and other molten metal are teemed and cooled to a solid state is avoided and the use of topping compounds in such operations eliminated or substantially reduced by the provision of a removable and reusable cover covering the top of the mold cavity wherein the cover comprises elements combined into a single unit arranged to be set atop the mold and completely cover the metal, at least one of said elements having a heat-reflecting surface over the undersurface thereof for reflecting heat downwardly onto the metal in the mold to retard the cooling of the metal while the space or spaces between the elements provide insulation. At least the lowermost reflective element in the assembly may slope downwardly and inwardly toward the center of the cover, that is, they diverge upwardly from a central area toward the side walls so that radiant heat will be deflected downwardly and outwardly to retard cooling of the metal near the top from the sides toward the center.

8 Claims, 5 Drawing Figures

FIG. 3.
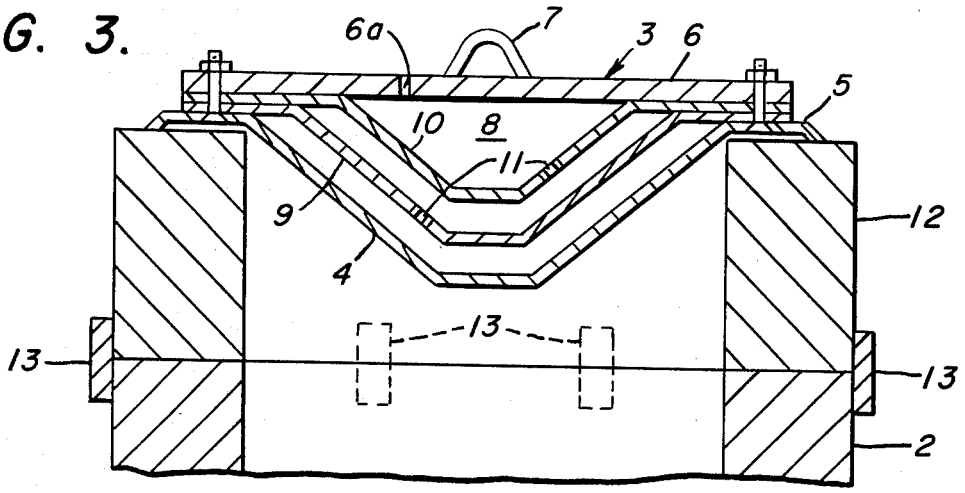
FIG. 4.
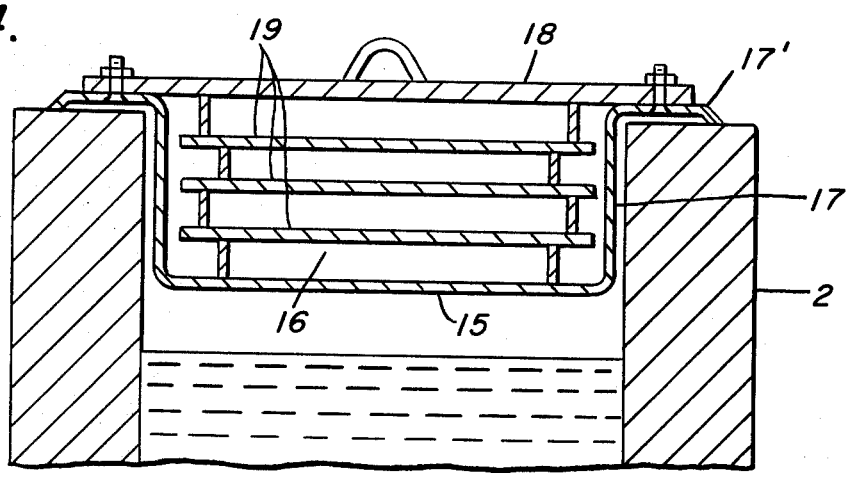
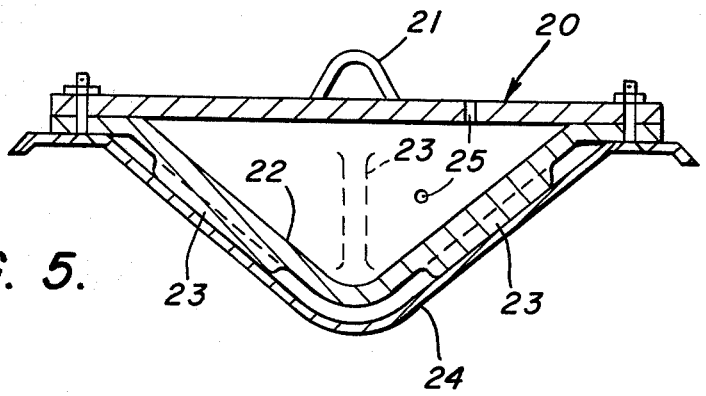
FIG. 5.

INGOT MOLD WITH HEAT REFLECTING COVER

This invention relates to the casting or teeming of molten metal in permanent molds, typically, but not exclusively, the solidification of molten steel and steel alloys in ingot molds.

It is, of course, well known that ingots are cast in vertically elongated molds by pouring the molten metal into the mold where it solidifies after a period of time into a solid body or ingot. It is also a matter of common knowledge that the metal solidifies progressively from bottom to top and from the sides toward the center and that it shrinks away from the center toward the cooler side walls as it solidifies, leaving in the upper end of the ingot an axially extending cavity from the top downwardly, sometimes for a considerable distance into the ingot. This cavity is referred to as a "pipe" and the top of the ingot in which this pipe results must be cropped and scrapped.

To overcome or reduce the pipe, various attempts have been made to retard solidification of the molten material at the top of the mold and thereby provide a body of molten "sink metal" that will flow down into the pipe as it tends to form, with the result that the pipe will extend less deeply into the center of the ingot and reduce substantially the length of the ingot that must be cropped.

One common expedient is to provide a refractory insert at the top of the mold, known as a "hot top." This is designed to retain a body of sink metal above the top of the ingot as the ingot cools and loss of heat is retarded by refractory walls of the hot top. Another common expedient used in conjunction with or separately from hot-topping is the application of a topping compound over the molten metal in the mold. This may comprise particles of inorganic or earthen material that floats and covers the molten metal, or may comprise an exothermic compound, either alone or combined with other inorganic material covering the top of the molten metal. In addition to providing insulation, the exothermic material, usually aluminum dross, will react with oxygen in the air to generate heat at the surface of the metal in the mold.

The refractory hot-tops are usable but one single time. Topping compounds also are discarded after a single use, and their use generates considerable dust and atmospheric pollution with the emission of smoke and fumes.

BRIEF SUMMARY OF THE INVENTION

According to this invention, there is provided a reusable cover to be placed over the open top of the mold after the molten metal has been teemed into the mold and the inner surface of this cover is spaced above and out of contact with the molten metal. It provides at least one, and desirably more than one, reflective layer. When positioned above the mold as a cover, radiant heat is reflected back into the molten metal. With the reflector or reflectors having upwardly and outwardly sloping reflective surfaces, the heat will be reflected more intensely away from the center toward and against the side walls to thereby retard cooling and solidification of the sink-metal at the top of the mold from the exterior toward the center. Heat insulation is provided in the cover by the use of one or more air spaces between the lowermost and uppermost elements of the assembly Essentially the cover comprises two principal members. The first is a lower dished member with a peripheral flange and the second is a top of larger than the mold opening to the underside of which the flange of the lower member is secured, an air space being formed between concavity of the dished lower member and the top member. One of these members has or supports a downwardly facing heat reflecting surface. By sloping the cavity walls of the dished member to diverge upwardly and outwardly, the reflected radiant heat will impinge the side walls of the mold, or an extension thereof, and the metal surrounding the central area of the mold more than the metal on the central area.

In the accompanying drawings, wherein certain preferred embodiments of the invention are disclosed:

FIG. 3 is a view similar to FIG. 1 where the mold has a separate extension thereon for supporting the cover;

FIG. 4 is a view similar to FIG. 1 of a modification where the sides of the dished lower member diverge upwardly to an inconsequential degree to facilitate manufacture of the cover but any slope of the walls is of little significance so far as heat concentration is involved; and FIG. 5 is a view similar to FIG. 1 of another modification.

Figure 1:
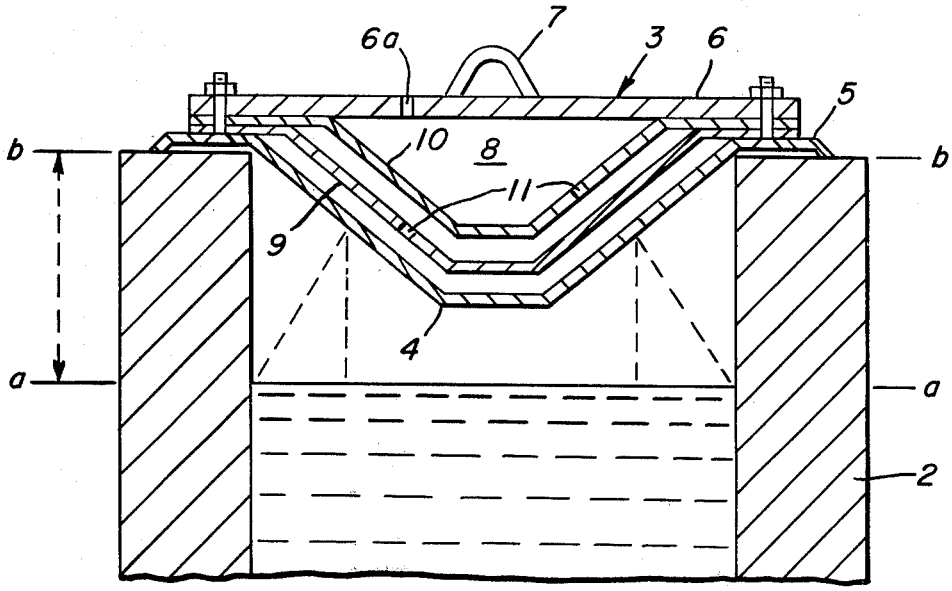
FIG. 1 is a transverse section showing the cover member in position at the top of the mold, which, in this case, is extending beyond the normal length to elevate the cover above the metal in the mold, including the sink-metal.
Figure 2:
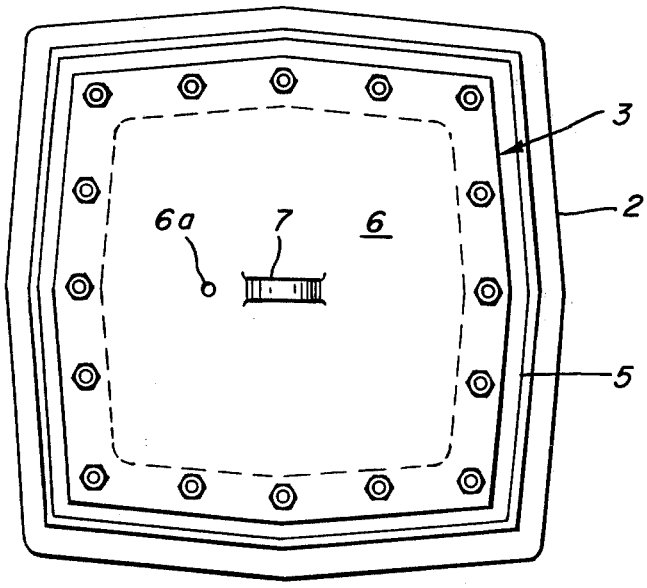
FIG. 2 is a top plan view of the FIG. 1.

Referring to FIGS. 1 and 2, the ingot mold is designated 2 and, as here shown, it is of generally square section. Assuming the ingot to be cast will terminate at about the level of line *a—a* in FIG. 1, the mold is extended a sufficient distance to accommodate in addition some shrink metal between level *a—a* and level *b—b* to flow down into the mold cavity as the metal cools and solidifies, and, in so doing, contracts the shrink metal flowing into the central cavity or "pipe" as it develops, as above explained.

This invention provides a cover, designated 3 in FIGS. 1 and 2, and its function is to reduce loss of heat from the molten metal in the top of the mold cavity and thereby keep the shrink metal longer in a liquid or flowable condition.

As here shown, the cover 3 comprises a minimum of two elements. There is a lower dished element 4, here shown to be of heavy sheet metal, with the concavity being of inverted conical or truncated inverted conical or pyramidal shape. It has a peripheral flange 5. The flange 5 is designed to overlap the top of the mold 2 while the inverted conical portion aids in centering the cover on the top of the mold.

The second element of the cover is a cover plate 6 which may be of cast or plate metal, to the peripheral portion of which the flange 5 of the lower member is joined, preferably by a separable connection, such as a plurality of bolts and nuts. This facilitates repair or replacement of the lower member if it is damaged. The cover plate is provided with a lifting eye or like means 7 to facilitate placing of the cover on the mold or its removal therefrom.

The space below the cover plate which spans the concavity in the dished element provides a dead air space 8 that serves to provide insulation against the escape of heat. A vent opening 6*a* allows restricted outflow of air as the cover heats up and inflow of air as the cover cools. More particularly, one or both of elements 4 and 6 has its lower surface provided with a polished heat reflecting surface. This is most effectively provided on the undersurface of the element 4, which itself may be polished stainless steel on which may support a separate stainless steel reflector or possibly may be coated or plated with a reflective layer or heat-resistant film.

While at least two elements are necessary to provide a dead air space between them, additional elements, such as elements 9 and 10, concentric with but within the dished element 4 are desirably used to divide the air space into successive layers, as shown, and these may communicate through restricted openings 11.

The inverted conical shape of the dished lower element, providing upwardly and outwardly divergent sides, is particularly desirable because heat radiated vertically from the molten shrink metal will be reflected outwardly and downwardly against the mold walls and the peripheral area of the molten metal, thereby retarding the cooling of the metal inwardly from the outside toward the center. The longer the peripheral sink metal can be kept from solidifying, the slower will the central area of this body solidify and remain fluid.

FIG. 3 shows a cover similar to that shown in FIGS. 1 and 2 and corresponding reference numerals have been used to designate corresponding parts. However, instead of the mold having an integral extension to provide extra length to accommodate the cover, there is provided a separate extension member 12 to set, flush, on the top of the ingot mold, with downwardly extending lugs 13 thereabout to center the extension on top of the mold. They function the same as dowels projecting from the extension into cavities in the top end of the mold. This extension will be sufficiently heavy to resist floating and, if necessary, any well-known type of hooks or latches may be used. The dished lower member and the reflective elements above it are not dished so deeply, or they may represent a longitudinal section through a rectangular mold.

The modification shown in FIG. 4 is generally similar to that shown in FIG. 1 but without the inverted conical contour of FIG. 1. In this figure there is a lower dished element 15 providing a cavity 16 with nearly vertical sides 17 terminating at the top in a laterally extending flange 17' that rests on top of the ingot mold. The dished portion of this member is of a dimension and shape to have only a free working fit inside the mold cavity so that, hot or cold, it may be readily fitted into and removed from the end of the mold, or from an extension thereof, as shown in FIG. 3.

There is a cover plate 18 to the underside of which the flange is secured with the upper and lower elements of the assembly being properly centered. Here again, a separable connection may be provided between the flange of the dished lower member and the cover plate. As in FIG. 1, the cover plate has a lifting eye or the like.

Within the cavity of the dished mmeber there are shown a plurality of metal disks 19 therein, all of which are preferably of heat reflecting metal, with spacing rings or blocks by which the lowermost one is supported on the bottom of the cavity and the others are in turn supported on one another, providing layers of air spaces as in FIG. 1.

In FIG. 5 the cover plate 20 is a relatively heavy casting with a lifting eye or the like 21 and of a size and shape to rest on the top of an ingot mold or an extension thereof, as previously described. There is a dished cast member 22, which is also a reflector, of generally inverted conical or pyramidal shape secured at its periphery by a flange to the edge of the cover plate as indicated. Cast metal ribs 23 are spaced from one another on the underside of the dished casting 22 and converge toward the center to support a sheet metal reflecting sheet 24 below the casting 22 and held in spaced relation thereto by the ribs 23. This thin reflecting sheet also has a flange that is secured to the underside edges of the cover and casting 22 by the same fastening means that secure members 20 and 22 together. Air spaces are provided between the cover plate and the casting 22 and between this casting and the bottom reflector and vents are indicated at 25.

The reflective surface on the cast member 22, depending upon the metal of which it is made, may be provided by the surface finish on the casting itself, or by electrodeposition of a lustrous surface, or other applied film or coating or lustrous foil fitted thereto. The reflecting sheet 24 provides protection for the surface of the casting 22, however finished, and may be replaced when damaged, heat blackened, or otherwise requires replacement. In fact, it may even serve primarily as a protector for the reflective surface of the casting 22, with any reflectivity being incidental to these protective functions.

To the extent that it may be desirable or feasible to do so, parts of different forms herein illustrated may be interchanged, as will be readily understood by those skilled in the art.

I claim:

1. In the combination of an ingot mold having vertically extending side walls enclosing a mold cavity with the upper ends of the side walls defining a rim about the upper end of the mold cavity, and a reusable heat reflecting cover supported on the upper end of the side walls, the invention wherein the cover is of a size and shape to substantially close the upper end of the cavity when the cover is in position over the cavity and is seated on the upper ends of the side walls of the mold surrounding the cavity, the reusable cover comprising at least two members, one of which is a lower member and the other of which is a top plate, the lower member comprising a heat reflector arranged to reflect heat downwardly into the mold cavity and having a dished central area which extends down into the mold cavity when the cover is in place on the mold but which is at a level above the level to which hot metal is poured into the mold, the lower member being suspended around its edges from the undersurface of the top plate, and an insulating air space between the dished central area of the lower member and the top plate.

2. The combination defined in claim 1 wherein the lower member is shaped to center the cover over the mold cavity.

3. The combination defined in claim 1 in which the top plate has a heat reflecting undersurface.

4. The combination defined in claim 2 wherein at least one of the heat reflecting surfaces is comprised of polished stainless steel.

5. The combination defined in claim 1 in which the dished area of the lower member slopes downward and inward from the rim of the mold on which the cover is placed toward a lowermost central area of the lower member.

6. The combination defined in claim 1 wherein there is at least one sheet metal partition extending across the said air space dividing it into upper and lower insulating compartments which are substantially parallel with each other and extend in a direction crosswise of the mold cavity over which the cover extends.

7. The combination defined in claim 6 in which there are a plurality of such sheet metal partitions parallel with one another dividing the air space into several compartments.

8. The combination defined in claim 8 in which the top plate has a vent opening through which said air space communicates with the atmosphere outside the mold and cover.

* * * * *